United States Patent [19]

Abel et al.

[11] 4,375,506

[45] Mar. 1, 1983

[54] TIMING LAYERS FOR COLOR TRANSFER ASSEMBLAGES CONTAINING POSITIVE-WORKING REDOX DYE-RELEASERS AND DEVELOPMENT ACCELERATORS

[75] Inventors: Edward P. Abel, Webster; Edward Weissberger, Pittsford, both of N.Y.

[73] Assignee: Eastman Kodak Company, Rochester, N.Y.

[21] Appl. No.: 316,701

[22] Filed: Oct. 30, 1981

[51] Int. Cl.[3] ..... G03C 1/40; G03C 1/10; G03C 5/54

[52] U.S. Cl. ..... 430/215; 430/212; 430/218; 430/223; 430/236; 430/239; 430/454; 430/531; 430/536; 430/523

[58] Field of Search ..... 430/212, 215, 218, 223, 430/236, 239, 454, 531, 536, 523

[56] References Cited

U.S. PATENT DOCUMENTS

| | | | |
|---|---|---|---|
| 3,421,893 | 1/1969 | Taylor | 430/215 |
| 3,455,686 | 7/1969 | Farney et al. | 430/215 |
| 4,061,496 | 12/1977 | Hannie et al. | 430/215 |
| 4,139,379 | 2/1979 | Chasman et al. | 430/223 |
| 4,139,389 | 2/1979 | Hinshaw et al. | 430/223 |
| 4,190,447 | 2/1980 | Coil et al. | 430/215 |
| 4,201,578 | 5/1980 | Abbott | 430/566 |
| 4,314,020 | 2/1982 | Reed et al. | 430/215 |

*Primary Examiner*—Richard L. Schilling
*Attorney, Agent, or Firm*—Harold E. Cole

[57] ABSTRACT

Photographic assemblages, elements, receiving elements and cover sheets comprise a combination of two timing layers and a neutralizing layer for use with negative-working silver halide emulsions and positive-working redox dye-releasers. The outermost timing layer has a negative temperature coefficient and has a development accelerator associated therewith to increase the development of the silver halide emulsion at low temperatures. The timing layer next to the neutralizing layer has a greater penetration time by the alkaline processing composition so that the neutralizing layer is permeated only after silver halide development has been substantially completed. The temperature latitude of the system is thereby increased.

39 Claims, No Drawings

TIMING LAYERS FOR COLOR TRANSFER ASSEMBLAGES CONTAINING POSITIVE-WORKING REDOX DYE-RELEASERS AND DEVELOPMENT ACCELERATORS

This invention relates to photography, and more particularly to photographic assemblages, elements, receiving elements and cover sheets for color diffusion transfer photography employing at least one negative-working silver halide emulsion and a positive-working redox dye-releaser (RDR) wherein a combination of two timing layers is employed along with a neutralizing layer. The first timing layer, which is the furthest of the two from the neutralizing layer, has a negative temperature coefficient and has associated therewith a development accelerator to increase development of the silver halide emulsion at low temperatures. The second timing layer, which is closest to the neutralizing layer, has a greater penetration time by the alkaline processing composition so that the neutralizing layer is permeated only after development has been substantially completed. The assemblage is then neutralized by the neutralizing layer.

Various formats for color, integral transfer elements are described in the prior art, such as U.S. Pat. Nos. 3,415,644; 3,415,645; 3,415,646; 3,647,437; 3,635,707; 3,756,815, and Canadian Patents 928,559 and 674,082. In these formats, the image-receiving layer containing the photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject.

Other so-called "peel apart" formats for color diffusion transfer assemblages are described, for example, in U.S. Pat. Nos. 2,983,606; 3,362,819 and 3,362,821. In these formats, the image-receiving element is separated from the photosensitive element after development and transfer of the dyes to the image-receiving layer.

In color transfer assemblages such as those described above, a "shut-down" mechanism is needed to stop development after a predetermined time, such as 20 to 60 seconds in some formats, or up to 3 to 10 minutes or more in other formats. Since development occurs at a high pH, it is rapidly slowed by merely lowering the pH. The use of a neutralizing layer, such as a polymeric acid, can be employed for this purpose. Such a layer will stabilize the element after silver halide development and the required diffusion of dyes has taken place. A timing layer is usually employed in conjunction with the neutralizing layer, so that the pH is not prematurely lowered, which would prematurely restrict development. The development time is thus established by the time it takes the alkaline composition to penetrate through the timing layer. As the system starts to become stabilized, alkali is depleted throughout the structure, causing silver halide development to substantially cease in response to this drop in pH. For each image generating unit, this shutoff mechanism establishes the amount of silver halide development and the related amount of dye released or formed according to the respective exposure values.

In color transfer assemblages employing non-diffusible RDR's which are positive-working, a dye is released as an inverse function of development, i.e., dye is released by some mechanism in the non-exposed areas of the silver halide emulsion. Use of a negative-working silver halide emulsion in such a system will therefore produce a positive image in the image-receiving layer. Examples of such positive-working RDR's are described in U.S. Pat. Nos. 4,139,379 and 4,139,389. The immobile compounds described in these patents are ballasted electron-accepting nucleophilic displacement (BEND) compounds. The BEND compound as incorporated in a photographic element is incapable of releasing a diffusible dye. However, during photographic processing under alkaline conditions, the BEND compound is capable of accepting at least one electron (i.e. being reduced) from an incorporated reducing agent (IRA) and thereafter releases a diffusible dye. This occurs in the unexposed areas of the emulsion layer. In the exposed areas of the emulsion layer, however, an electron transfer agent (ETA) reduces the silver halide and becomes oxidized. The oxidized ETA is then reduced by the IRA, thus preventing the IRA from reacting with the BEND compound. The BEND compound therefore is not reduced and thus no dye is released in the exposed areas. After a relatively short period of time, the initial silver development provides image discrimination. Thereafter, excess IRA must be removed to prevent indiscriminant dye release. This is accomplished by allowing the silver halide emulsions to go into "total fog", i.e., the remaining silver halide is reduced to metallic silver. When this occurs, the remaining IRA becomes oxidized. Thus, no further reduction and release of dye from the BEND compound can occur.

To provide image discrimination in this system, there is competition for the IRA by the oxidized ETA and the BEND compound. The reduction of silver halide by the ETA and the subsequent reaction of the oxidized ETA with the IRA must be faster than direct reaction of the BEND compound with the IRA in order to get significant image discrimination. A problem occurs in such a system, however, when the processing temperature varies. As the temperature increases, say from 10° C. to 38° C., the rate of silver halide development rapidly increases. At the same time, the rate of the two competing reactions involving the IRA will also increase, but not as much as the silver halide development rate. An imbalance between the silver halide development rate and the two competing reaction rates therefore occurs as the processing temperature varies.

It would be desirable to provide a way to cause the rates of these two competing reactions to vary approximately the same as the silver halide development rate over a range of temperatures encountered in diffusion transfer processing, so as to improve the temperature latitude of the system. In this way, equivalent sensitometry, as evaluated by transferred dye, will be obtained during processing over a wide range of ambient temperatures.

U.S. Pat. No. 4,061,496 relates to a combination of two timing layers in various photographic elements. These timing layers are characterized as having a certain activation energy of penetration by an aqueous alkaline solution. These timing layers have a positive temperature coefficient (most chemical reactions have a positive temperature coefficient, i.e., the reaction proceeds faster as the temperature increases). Thus, these timing layers become more permeable and have a shorter penetration time by alkaline processing composition at higher temperatures.

In U.S. Pat. No. 4,201,578, hydroquinone esters are disclosed for use with color image transfer systems. These esters may be incorporated in or behind one or more timing layers. In column 9, it is disclosed that in a "double" timing layer embodiment, the hydroquinone ester is incorporated in the innermost timing layer, and the outermost timing layer has a positive temperature coefficient (column 2, lines 47–52). There is no teaching in that patent, however, to employ such compounds in the outermost timing layer or to use a negative temperature coefficient timing layer as the outermost timing layer.

U.S. Pat. Nos. 3,455,686 and 3,421,893 relate to a negative temperature coefficient timing layer, i.e., one which becomes less permeable and has a longer penetration or breakdown time at higher temperatures. There is no teaching in these patents, however, that this timing layer should be used with positive-working RDR's, or that two timing layers should be employed with the outer one containing a development accelerator, or that the innermost timing layer should be such that its penetration time by the processing composition is greater than that of the outermost timing layer, so that the neutralizing layer will be permeated only after silver halide development has been substantially completed.

U.S. Pat. No. 4,190,447 and Japanese Application No. J54/154,324 also relate to the use of two timing layers. Again, however, they are not described as having a negative temperature coefficient or as having a silver halide development accelerator associated therewith as described herein.

U.S. Ser. No. 175,224 of Reed, Saturno and Ducharme relate to the use of two timing layers in color transfer systems. However, the outermost timing layer in that application is not described as having a negative temperature coefficient, and contains a silver halide development inhibitor rather than a silver halide development accelerator, as described herein.

Our U.S. Ser. No. 316,630, filed of even date herewith, entitled "Timing Layers and Auxiliary Neutralizing Layer for Color Transfer Assemblages Containing Positive-Working Redox Dye-Releasers", also relates to temperature latitude control in positive-working RDR systems by use of a negative temperature coefficient timing layer in conjunction with an auxiliary acid layer. That application therefore relates to another way of solving the same problem that this application solves.

A photographic assemblage in accordance with our invention comprises:

(a) a photographic element comprising a support having thereon at least one negative-working, photo-sensitive silver halide emulsion layer having associated therewith a dye image-providing material comprising a positive-working, redox dye-releaser;

(b) a dye image-receiving layer;

(c) a neutralizing layer for neutralizing an alkaline processing composition;

(d) a first timing layer located between the neutralizing layer and the photosensitive silver halide emulsion layer; and (e) a second timing layer located between the first timing layer and the neutralizing layer;

the first and second timing layers being so located that the processing composition must first permeate the timing layers before contacting the neutralizing layer, the neutralizing layer being located on the side of the second timing layer which is farthest from the dye image-receiving layer, and wherein:

(i) the first timing layer has a negative temperature coefficient and has a silver halide development accelerator associated therewith; and (ii) the second timing layer has a penetration time by the alkaline processing composition that is greater than the penetration time of the first timing layer, so that the neutralizing layer will be permeated by the alkaline processing composition only after development of the silver halide emulsion has been substantially completed.

We have found that the particular combination of timing layers described above greatly improves the temperature latitude of the assemblage. At low temperatures, the first or outermost timing layer is more rapidly permeated than at high temperatures and therefore releases development accelerator more quickly, which in turn will increase silver halide development. Conversely, at high temperatures, the first or outermost timing layer will be permeated more slowly and will therefore release development accelerator more slowly. Silver halide development will therefore be only moderately accelerated. The development accelerator therefore proportionately accelerates silver development more at lower temperatures than at higher temperatures. The silver halide development rate will therefore maintain its position relative to the competing reaction rates described above throughout the temperature range of processing.

Although both silver development and dye release rates increase with increasing temperature, the rate of development of negative-working emulsions used in this system is believed to have a greater positive temperature coefficient than that of dye release from the positive RDR. Accelerating silver development at low temperatures relative to dye release provides a better net balance of silver halide development and dye release rates. The difference between the silver halide development rate and the dye release rate will thereby be substantially the same over the operative temperature range.

After development of the silver halide emulsion has been substantially completed, then the second timing layer and its adjacent neutralizing layer are permeated to lower the pH of the unit. This will prevent any slow hydrolysis of the positive RDR which would further release dye. Lowering the pH also prevents physical degradation of the photographic element.

Any positive-working RDR's known in the art may be employed in our invention. Such RDR's are disclosed, for example, in U.S. Pat. Nos. 4,139,379, 4,199,354, 3,980,479 and 4,139,389, the disclosures of which are hereby incorporated by reference. In a preferred embodiment of our invention, the positive-working RDR is a quinone RDR and the photographic element contains an incorporated reducing agent as described in U.S. Pat. No. 4,139,379, referred to above. In another preferred embodiment, the quinone RDR's have the formula:

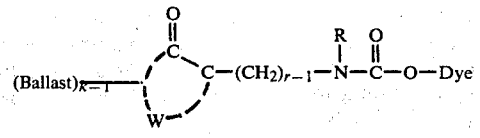

wherein:

Ballast is an organic ballasting radical of such molecular size and configuration as to render the compound nondiffusible in the photographic element during development in an alkaline processing composition;

W represents at least the atoms necessary to complete a quinone nucleus;

r is a positive integer of 1 or 2;

R is an alkyl radical having 1 to about 40 carbon atoms or an aryl radical having 6 to about 40 carbon atoms;

k is a positive integer of 1 to 2 and is 2 when R is a radical of less than 8 carbon atoms; and Dye is an organic dye or dye precursor moiety.

As described above, the first timing layer has a negative temperature coefficient. Such a layer becomes less permeable and has a longer breakdown or penetration time by alkaline processing composition as the processing temperature increases. Such materials are well known in the art as described in U.S. Pat. Nos. 3,455,686 and 3,421,893, the disclosures of which are hereby incorporated by reference. In a preferred embodiment, polymers are employed which are formed from N-substituted acrylamides, such as N-methyl-, N-ethyl-, N,N-diethyl-, N-hydroxyethyl-, or N-isopropylacrylamide, used either alone or in combination with up to about 30% by weight of acrylamide or an acrylate ester such as 2-hydroxyethyl acrylate. In a highly preferred embodiment, poly(N-isopropylacrylamide-co-acrylamide) (90:10 weight ratio) is employed.

Any silver halide development accelerator may be employed in our invention as long as it performs the desired function. Examples of such materials include aminophenols, such as o- or p-aminophenol or N-methyl-p-aminophenol, reductones such as piperidinohexose reductone, and pyrazolidinones such as 4-hydroxymethyl-4-methyl-1-p-tolyl-3-pyrazolidinone and 4,4-dimethyl-1-phenyl-3-pyrozolidinone. In a preferred embodiment, hydroquinone esters or precursors thereof are employed as described in U.S. Pat. No. 4,201,578, the disclosure of which is hereby incorporated by reference, such as methylhydroquinone, t-butylhydroquinone, t-butylhydroquinone monoacetate, t-butylhydroquinone diacetate, methylhydroquinone monoacetate, phenylhydroquinone monoacetate or 2,5-dimethylhydroquinone. The concentration of the development accelerator employed can be any amount effective for the intended purpose. In general, good results have been obtained at a concentration of from 0.3 to 2.5 millimoles/$m^2$, preferably from 0.5 to 1.0 millimoles/$m^2$. The development accelerator may be located either in the outermost or first timing layer or in a permeable layer underneath this timing layer provided it will function in the manner described above.

Any material is useful as the second timing layer in our invention provided its penetration time by the alkaline processing composition is greater than that of the first timing layer, so that the neutralizing layer will be permeated only after development has been substantially completed. Suitable materials include those described above and those disclosed on pages 22 and 23 of the July, 1974 edition of *Research Disclosure, and on pages* 35–37 of the July, 1975 edition of *Research Disclosure, U.S. Pat. Nos.* 4,029,849; 4,061,496 and 4,190,447, the disclosures of which are hereby incorporated by reference. For the particular chemistry employed, the material can have either a positive or a negative temperature coefficient. The penetration time of this timing layer by alkaline processing composition is on the order of about 5 to 10 minutes, preferably 5 to 7 minutes. The breakdown or penetration time of the first timing layer is shorter, for example, 1 to 4 minutes, preferably 1 to 3 minutes. In general, the difference between the penetration times of these two timing layers should be at least about 2 minutes.

Timing layer penetration times or timing layer breakdown (TLB) times can be measured by a number of ways well known to those skilled in the art. One such way is to prepare a cover sheet by coating the timing layer whose TLB is to be measured over an acid layer on a support. An indicator sheet is then prepared consisting of thymolphthalein dye in a gelatin layer coated on a support. The indicator sheet is then soaked in a typical alkaline processing composition and then laminated to the cover sheet. The time for the change in color of the dye from blue to colorless indicates the TLB or time required to lower the pH below about 10.

The silver halide emulsions employed in our invention are the conventional, negative-working emulsions well known to those skilled in the art.

The photographic element in the above-described photographic assemblage can be treated in any manner with an alkaline processing composition to effect or initiate development. One method for applying processing composition is by interjecting processing solution with communicating members similar to hypodermic syringes which are attached either to a camera or camera cartridge. The processing composition can also be applied by means of a swab or by dipping in a bath, if so desired. Another method of applying processing compositions to a film assemblage which can be used in our invention is the liquid spreading means described in U.S. application Ser. No. 143,230 of Columbus, filed Apr. 24, 1980.

In another embodiment of the invention, the assemblage itself contains the alkaline processing composition and means containing same for discharge within the film unit, such as a rupturable container which is adapted to be positioned during processing of the film unit so that a compressive force applied to the container by pressure-applying members, such as would be found in a camera designed for in-camera processing, will effect a discharge of the container's contents within the film unit.

The dye image-receiving layer in the above-described film assemblage is optionally located on a separate support adapted to be superposed on the photographic element after exposure thereof. Such image-receiving elements are generally disclosed, for example, in U.S. Pat. No. 3,362,819. In accordance with this embodiment of our invention, the dye image-receiving element would comprise a support having thereon, in sequence, a neutralizing layer, a second timing layer as described previously, a first timing layer as described previously and a dye image-receiving layer. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

In another embodiment, the dye image-receiving layer in the above-described film assemblage is located integral with the photographic element and is located between the support and the lowermost photosensitive silver halide emulsion layer. One useful format for integral receiver-negative photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer, and dye images, formed as a function of development, diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention is employed is disclosed in Canadian Pat. No. 928,559. In this embodiment, the support for the photographic element is transparent and is coated with the image-receiving layer, a substantially opaque, light-reflective layer and the photosensitive layer or layers described above. A rupturable container, containing an alkaline processing composition and an opacifier, is positioned between the top layer and a transparent cover sheet which has thereon, in sequence, a neutralizing layer, a second timing layer as described previously and a first timing layer as described previously. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also contains a neutralizing layer and the timing layers according to this invention underneath the dye image-receiving layer.

In another embodiment of the invention, the neutralizing layer and timing layers of the invention are located underneath the photosensitive layer or layers. In that embodiment, the photographic element would comprise a support having thereon, in sequence, a neutralizing layer, a second timing layer as described previously, a first timing layer as described previously and at least one photosensitive silver halide emulsion layer having associated therewith a dye image-providing material. A dye image-receiving layer would be provided on a second support with the processing composition being applied therebetween. This format could either be peel-apart or integral, as described above.

A process for producing a photographic transfer image in color according to our invention from an imagewise exposed photosensitive element comprising a support having thereon at least one photosensitive silver halide emulsion layer having associated therewith a dye image-providing material as described above comprises treating the element with an alkaline processing composition in the presence of a silver halide developing agent or ETA to effect development of each of the exposed silver halide emulsion layers. The processing composition contacts the emulsion layer or layers prior to contacting a neutralizing layer. An imagewise distribution of dye image-providing material is thus formed as a function of development, and at least a portion of it diffuses to a dye image-receiving layer to provide the transfer image. A first timing layer, as described previously, associated with the neutralizing layer is permeated by the alkaline processing composition after a predetermined time, the first timing layer being located between the neutralizing layer and the photosensitive silver halide emulsion layer. This first timing layer releases the development accelerator contained therein as described above. A second timing layer, described above, associated with the neutralizing layer, is also permeated by the alkaline processing composition after a predetermined time, the second timing layer being located between the first timing layer and the neutralizing layer. This second timing layer is permeated by the alkaline processing composition after permeation of the first timing layer by the alkaline processing composition, so that the neutralizing layer will be permeated by the alkaline processing composition only after the silver halide development has been substantially completed. The first and second timing layers are so located that the processing composition must first permeate the timing layers before contacting the neutralizing layer, which is located on the side of the second timing layer which is farthest from the dye image-receiving layer. The alkaline processing composition is then neutralized by means of the neutralizing layer associated with the timing layers after the predetermined times.

The film unit or assemblage of the present invention is used to produce positive images in single or multicolors. In a three-color system, each silver halide emulsion layer of the film assembly will have associated therewith a dye-releasing compound which releases a dye possessing a predominant spectral absorption within the region of the visible spectrum to which said silver halide emulsion is sensitive, i.e., the blue-sensitive silver halide emulsion layer will have a yellow dye-releaser associated therewith, the green-sensitive silver halide emulsion layer will have a magenta dye-releaser associated therewith and the red-sensitive silver halide emulsion layer will have a cyan dye-releaser associated therewith. The dye-releaser associated with each silver halide emulsion layer is contained either in the silver halide emulsion layer itself or in a layer contiguous to the silver halide emulsion layer, i.e., the dye-releaser can be coated in a separate layer underneath the silver halide emulsion layer with respect to the exposure direction.

The concentration of the dye-releasing compounds that are employed in the present invention can be varied over a wide range, depending upon the particular compound employed and the results desired. For example, a dye-releaser coated in a layer at a concentration of 0.1 to 3 $g/m^2$ has been found to be useful. The dye-releaser can be dispersed in a hydrophilic film-forming natural material or synthetic polymer, such as gelatin, polyvinyl alcohol, etc, which is adapted to be permeated by aqueous alkaline processing composition.

A variety of silver halide developing agents are useful in this invention. Specific examples of developers or electron transfer agents (ETA's) useful in this invention include hydroquinone compounds, such as hydroquinone, 2,5-dichlorohydroquinone or 2-chlorohydroquinone; aminophenol compounds, such as 4-aminophenol, N-methylaminophenol, N,N-dimethylaminophenol, 3-methyl-4-aminophenol or 3,5-dibromoaminophenol; catechol compounds, such as catechol, 4-cyclohexylcatechol, 3-methoxycatechol, or 4-(N-octadecylamino)-catechol; phenylenediamine compounds, such as or N,N,N',N'-tetramethyl-p-phenylenediamine. In highly preferred embodiments, the ETA is a 3-pyrazolidinone compound, such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-dimethylphenyl)-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-dihydroxymethyl-3-pyrazolidinone, 1,4-di-methyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-di-methyl-3-pyrazolidinone, 1-(2-trifluoroethyl)-4,4-dimethyl-3-pyrazolidinone or 5-methyl-3-pyrazolidinone. A combination of different ETA's, such as those disclosed in U.S. Pat. No. 3,039,869, can also be employed. These ETA's are employed in the liquid processing composition or contained, at least in part, in any layer or layers of the photographic element or film unit to be activated by the alkaline processing composition, such as in the silver halide emulsion layers, the dye image-providing material layers, interlayers, image-receiving layer, etc.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid-and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye-releasers are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agents can be employed in various interlayers of the photographic elements of the invention. Suitable materials are disclosed on page 83 of the November 1976 edition of *Research Disclosure,* the disclosure of which is hereby incorporated by reference.

Any material is useful as the image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November, 1976 edition of *Research Disclosure,* the disclosure of which is hereby incorporated by reference.

Any material is useful as the neutralizing layer in this invention, as long as it performs the intended purpose. Suitable materials and their functions are disclosed on pages 22 and 23 of the July, 1974 edition of *Research Disclosure,* and pages 35 through 37 of the July, 1975 edition of *Research Disclosure,* the disclosures of which are hereby incorporated by reference.

The alkaline processing composition employed in this invention is the conventional aqueous solution of an alkaline material, e.g., alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of three primary regions of the spectrum can be disposed as a single segmented layer, e.g., as by the use of microvessels as described in Whitmore U.S. patent application Ser. No. 184,714, filed Sept. 8, 1980.

The negative-working silver halide emulsions useful in this invention, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein as the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following example is provided to further illustrate the invention.

EXAMPLE (A) A control cover sheet was prepared by coating the following layers, in the order recited, on a poly(ethylene terephthalate) film support:

(1) an acid layer comprising 14 g/m$^2$ poly(n-butyl acrylate-co-acrylic acid), (30:70 weight ratio equivalent to 140 meq. acid/m$^2$);

(2) a timing layer comprising 10.4 g/m$^2$ of cellulose acetate (40% acetyl) and 0.32 g/m$^2$ of poly(styrene-co-maleic anhydride) (50:50 weight ratio); and (3) an overcoat layer comprising 3.8 g/m$^2$ of gelatin.

(B) A comparison cover sheet was prepared similar to (A), except that the gelatin of layer 3 was replaced by a timing layer of 7.5 g/m$^2$ of poly(N-isopropylacrylamide-co-acrylamide) (90:10 weight ratio).

(C) A comparison cover sheet was prepared similar to (A) except that layer (3) contained 0.13 g/m$^2$ (1 mmole/m$^2$) of methylhydroquinone (MHQ).

(D) A cover sheet according to the invention was prepared similar to (B) except that timing layer (3) contained 0.13 g/m$^2$ (1 mmole/m$^2$) of methylhydroquinone (MHQ).

(E) A cover sheet according to the invention was prepared similar to (B) except that timing layer (3) contained 0.17 g/m$^2$ (1 mmole/m$^2$) of t-butylhydroquinone (t-butyl HQ).

(F) A cover sheet according to the invention was prepared similar to (B) except that timing layer (3) contained 0.22 g/m$^2$ (1 mmole/m$^2$) of t-butylhydroquinone monoacetate (t-butyl HQMA).

An integral imaging-receiver element was prepared by coating the following layers in the order recited on a transparent poly(ethylene terephthalate) film support. Quantities are parenthetically given in grams per square meter, unless otherwise stated.

(1) metal containing layer of nickel sulfate .6$H_2O$ (0.58) and gelatin (1.1);

(2) image-receiving layer of poly(4-vinylpyridine) (2.2) and gelatin (2.2);

(3) reflecting layer of titanium dioxide (17.3) and gelatin (2.6);

(4) opaque layer of carbon black (1.9) and gelatin (1.3);

(5) interlayer of gelatin (1.2);

(6) red-sensitive, negative-working silver bromoiodide emulsion (1.4 silver), gelatin (1.8), cyan PRDR (0.55), incorporated reducing agent IRA (0.29), and inhibitor (0.02);

(7) interlayer of gelatin (1.2) and scavenger (0.43);

(8) green-sensitive, negative-working, silver bromoiodide emulsion (1.4 silver), gelatin (1.6), magenta PRDR (0.58), incorporated reducing agent IRA (0.29), and inhibitor (0.007);

(9) interlayer of gelatin (1.1) and scavenger (0.43);

(10) blue-sensitive, negative-working silver bromoiodide emulsion (1.4 silver), gelatin (2.2), yellow PRDR (0.46), incorporated reducing agent IRA (0.45), and inhibitor (0.007); and

(11) overcoat layer of gelatin (0.98).

CYAN PRDR
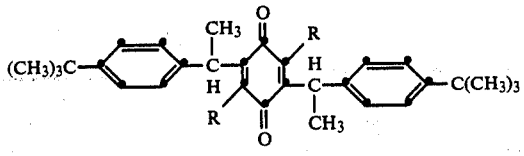
Where R=
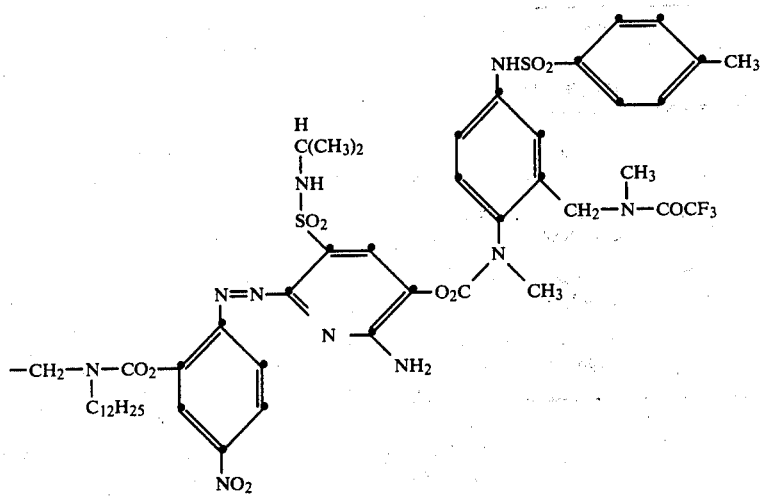
Dispersed in diethyllauramide (PRDR:solvent 2:1)
MAGENTA PRDR
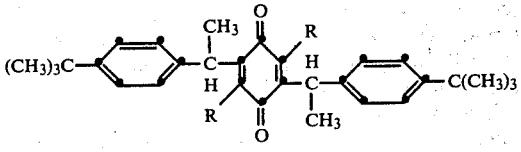
Where R=
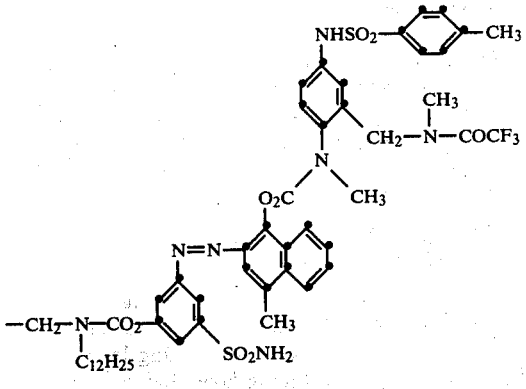
Dispersed in diethyllauramide (PRDR:solvent 1:1)
YELLOW PRDR
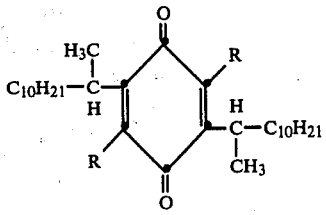
Where R=
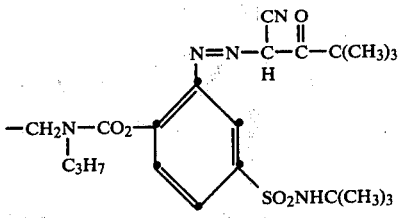
Codispersed with IRA and inhibitor in diethyllauramide (total solid:solvent 2:1)
IRA
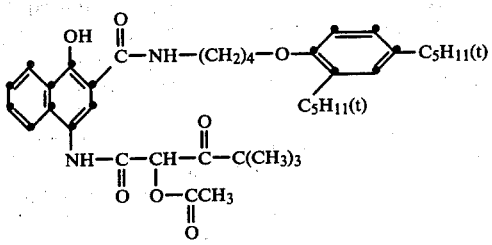
Codispersed with Inhibitor in diethyllauramide (Total solid:solvent 2:1)

INHIBITOR

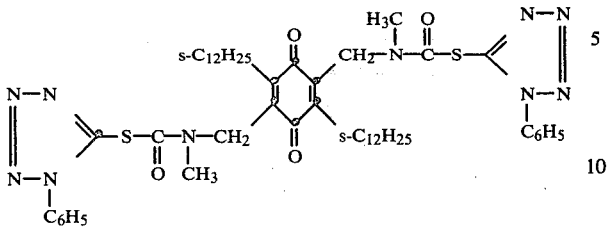

Codispersed with IRA in diethyllauramide (Total solid:solvent 2:1)

SCAVENGER

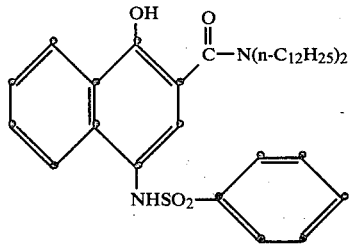

Samples of the imaging-receiver element were exposed in a sensitometer through a graduated density test object to yield a neutral at a Status A mid-scale density of approximately 1.0. The exposed samples were then processed at 10° and 38° C. by rupturing a pod containing the viscous processing composition described below between the imaging-receiver element and the cover sheets described above, by using a pair of juxtaposed rollers to provide a processing gap of about 75 μm.

The processing composition was as follows:

| | |
|---|---|
| 51 g | potassium hydroxide |
| 3.4 g | sodium hydroxide |
| 8 g | 4-methyl-4-hydroxymethyl-1-p-tolyl-3-pyrazolidinone |
| 10 g | ethylenediaminetetraacetic acid, disodium salt dihydrate |
| 0.5 g | lead oxide |
| 2 g | sodium sulfite |

-continued

| | |
|---|---|
| 2.2 g | Tamol SN® dispersant |
| 5 g | potassium bromide |
| 56 g | carboxymethylcellulose |
| 172 g | carbon |
| | water to 1 liter |

The maximum density (Dmax) and relative speed (measured at a density of 0.7) were read for R, G and B Status A density approximately 24 hours after lamination. The following results were obtained:

| Cover Sheet | Timing Layer | Dev. Accel. | | $D_{max}$ Status A Density 10° C. | 38° C. | Δ | 30 = 0.3 Log E Relative Log Speed 10° C. | 38° C. | Δ |
|---|---|---|---|---|---|---|---|---|---|
| A (Control) | Gelatin | None | R | 2.0 | 1.5 | −0.5 | 130 | 190 | +60 |
| | | | G | 1.7 | 1.5 | −0.2 | 130 | 150 | +20 |
| | | | B | 2.1 | 1.8 | −0.3 | 130 | 160 | +30 |
| B (Comparison) | Acrylamide Copolymer | None | R | 2.0 | 1.5 | −0.5 | 120 | 180 | +60 |
| | | | G | 1.8 | 1.6 | −0.2 | 130 | 140 | +10 |
| | | | B | 2.1 | 1.8 | −0.3 | 130 | 160 | +30 |
| C (Comparison) | Gelatin | MHQ | R | 1.8 | 1.2 | −0.6 | 155 | 200 | +45 |
| | | | G | 1.6 | 1.3 | −0.3 | 150 | 150 | 0 |
| | | | B | 2.0 | 1.6 | −0.4 | 155 | 170 | +15 |
| D | Acrylamide Copolymer | MHQ | R | 1.7 | 1.4 | −0.3 | 180 | 180 | 0 |
| | | | G | 1.6 | 1.6 | 0 | 160 | 145 | −15 |
| | | | B | 2.0 | 1.8 | −0.2 | 155 | 155 | 0 |
| E | Acrylamide Copolymer | t-butyl HQ | R | 1.8 | 1.3 | −0.5 | 195 | 185 | −10 |
| | | | G | 1.5 | 1.5 | 0 | 175 | 145 | −30 |
| | | | B | 2.0 | 1.7 | −0.3 | 170 | 160 | −10 |
| F | Acrylamide Copolymer | t-butyl HQMA | R | 1.8 | 1.4 | −0.2 | 190 | 190 | 0 |
| | | | G | 1.5 | 1.5 | 0 | 165 | 145 | −20 |
| | | | B | 2.0 | 1.8 | −0.2 | 160 | 155 | −5 |

The above sensitometric data show that the three cover sheets of the invention D, E, and F, have a much narrower red and blue speed change from 10° to 38° C. process temperature. All speeds are better relatively balanced and Dmax losses at 38° C. are lessened in comparison to cover sheets A, B and C.

The above data also shows that both the negative temperature coefficient timing layer and the development accelerator must be used in combination in accordance with our invention to obtain the best temperature latitude. Use of the development accelerator in gelatin (cover sheet C) or the negative temperature coefficient timing layer without development accelerator (cover sheet B) offers only minor benefit in improving process temperature latitude.

The invention has been described in detail with particular reference to a preferred embodiments thereof, but it will be understood that variations and modifications can be effected within the spirit and scope of the invention.

What is claimed is:

1. In a photographic assemblage comprising:

(a) a photographic element comprising a support having thereon at least one negative-working photosensitive silver halide emulsion layer having associated therewith a positive-working, redox dye-releaser;

(b) a dye image-receiving layer;

(c) a neutralizing layer for neutralizing an alkaline processing composition;

(d) a first timing layer located between said neutralizing layer and said silver halide emulsion layer; and (e) a second timing layer located between said first timing layer and said neutralizing layer;

said first and second timing layers being so located that said processing composition must first permeate said timing layers before contacting said neutralizing layer, said neutralizing layer being located on the side of said second timing layer which is farthest from said dye image-receiving layer, the improvement wherein:

(i) said first timing layer has a negative temperature coefficient and has a silver halide development accelerator located therein or in a layer intermediate said first and second timing layers; and (ii) said second timing layer has a penetration time by said alkaline processing composition that is greater than the penetration time of said first timing layer, so that said neutralizing layer will be permeated by said alkaline processing composition only after development of said silver halide emulsion has been substantially completed.

2. The assemblage of claim 1 wherein said positive-working redox dye-releaser is a quinone redox dye-releaser and said photographic element contains an incorporated reducing agent.

3. The assemblage of claim 2 wherein said quinone redox dye-releaser has the formula:

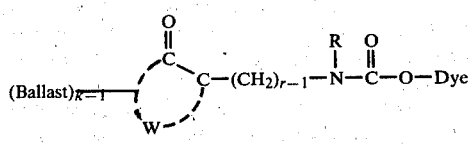

wherein:

Ballast is an organic ballasting radical of such molecular size and configuration as to render said compound nondiffusible in said photographic element during development in said alkaline processing composition;

W represents at least the atoms necessary to complete a quinone nucleus;

r is a positive integer of 1 or 2;

R is an alkyl radical having 1 to about 40 carbon atoms or an aryl radical having 6 to about 40 carbon atoms;

k is a positive integer of 1 to 2 and is 2 when R is a radical of less than 8 carbon atoms; and Dye is an organic dye or dye precursor moiety.

4. In the assemblage of claim 1, the further improvement wherein said first timing layer is an N-substituted acrylamide polymer or copolymer.

5. In the assemblage of claim 4, the further improvement wherein said first timing layer comprises poly(N-isopropylacrylamide-co-acrylamide) (90:10 weight ratio).

6. In the assemblage of claim 1, the further improvement wherein said development accelerator is a hydroquinone ester or precursor thereof.

7. In the assemblage of claim 1, the further improvement wherein the penetration time of said first timing layer is from about 1 to about 3 minutes and the penetration time of said second timing layer is from about 5 to about 7 minutes.

8. In a photographic assemblage comprising:

(a) a photographic element comprising a support having thereon at least one negative-working photosensitive silver halide emulsion layer having associated therewith a positive-working, redox dye-releaser;

(b) a dye image-receiving layer;

(c) an alkaline processing composition and means for discharging same within said assemblage;

(d) a neutralizing layer for neutralizing said alkaline processing composition;

(e) a first timing layer located between said neutralizing layer and said silver halide emulsion layer; and (f) a second timing layer located between said first timing layer and said neutralizing layer;

said first and second timing layers being so located that said processing composition must first permeate said timing layers before contacting said neutralizing layer, said neutralizing layer being located on the side of said second timing layer which is farthest from said dye image-receiving layer, said assemblage containing a silver halide developing agent, the improvement wherein:

(i) said first timing layer has a negative temperature coefficient and has a silver halide development accelerator located therein or in a layer intermediate said first and second timing layers; and (ii) said second timing layer has a penetration time by said alkaline processing composition that is greater than the penetration time of said first timing layer, so that said neutralizing layer will be permeated by said alkaline processing composition only after development of said silver halide emulsion has been substantially completed.

9. The assemblage of claim 8 wherein:

(a) said dye image-receiving layer is located between said support and said silver halide emulsion layer; and (b) said assemblage also includes a transparent cover sheet over the layer outermost from said support.

10. The assemblage of claim 9 wherein said transparent cover sheet is coated with, in sequence, said neutralizing layer, said second timing layer and said first timing layer.

11. The assemblage of claim 10 wherein said discharging means is a rupturable container containing said alkaline processing composition and an opacifying agent, said container being so positioned during processing of said assemblage that a compressive force applied to said container will effect a discharge of the container's contents between said transparent sheet and the layer outermost from said support.

12. The assemblage of claim 8 wherein said support having thereon said silver halide emulsion layer is opaque, and said dye image-receiving layer is located on a separate transparent support superposed on the layer outermost from said opaque support.

13. The assemblage of claim 12 wherein said transparent support has thereon, in sequence, said neutralizing layer, said second timing layer, said first timing layer and said dye image-receiving layer.

14. The assemblage of claim 12 wherein said opaque support has thereon, in sequence, said neutralizing layer, said second timing layer, said first timing layer and said silver halide emulsion layer.

15. In an integral photographic assemblage comprising:

(a) a photographic element comprising a transparent support having thereon the following layers in sequence: a dye image-receiving layer; an alkaline solution-permeable, light-reflective layer; an alkaline solution-permeable, opaque layer; a red-sensitive, negative-working, silver halide emulsion layer having a ballasted, positive-working, redox cyan dye-releaser associated therewith; a green-sensitive, negative-working, silver halide emulsion layer having a ballasted, positive-working, redox magenta dye-releaser associated therewith; and a blue-sensitive, negative-working, silver halide emulsion layer having a ballasted, positive-working, redox yellow dye-releaser associated therewith;

(b) a transparent sheet superposed over said blue-sensitive silver halide emulsion layer and comprising a transparent support coated with, in sequence, a neutralizing layer, a second timing layer, and a first timing layer; and (c) a rupturable container containing an alkaline processing composition and an opacifying agent, said container being so positioned during processing of said assemblage that a compressive force applied to said container will effect a discharge of the container's contents between said transparent sheet and said blue-sensitive silver halide emulsion layer;

said assemblage containing a silver halide developing agent, the improvement wherein:

(i) said first timing layer has a negative temperature coefficient and has a silver halide development accelerator located therein or in a layer intermediate said first and second timing layers; and (ii) said second timing layer has a penetration time by said alkaline processing composition that is greater than the penetration time of said first timing layer, so that said neutralizing layer will be permeated by said alkaline processing composition only after development of said silver halide emulsion has been substantially completed.

16. The assemblage of claim 15 wherein each said positive-working redox dye-releaser is a quinone redox dye-releaser and said photographic element contains an incorporated reducing agent.

17. The assemblage of claim 16 wherein said quinone redox dye-releaser has the formula:

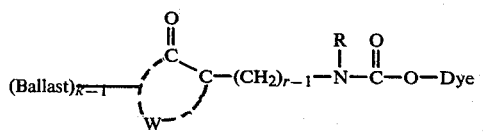

wherein:

Ballast is an organic ballasting radical of such molecular size and configuration as to render said compound nondiffusible in said photographic element during development in said alkaline processing composition;

W represents at least the atoms necessary to complete a quinone nucleus;

r is a positive integer of 1 or 2;

R is an alkyl radical having 1 to about 40 carbon atoms or an aryl radical having 6 to about 40 carbon atoms;

k is a positive integer of 1 to 2 and is 2 when R is a radical of less than 8 carbon atoms; and Dye is an organic dye or dye precursor moiety.

18. In the assemblage of claim 15, the further improvement wherein said first timing layer is an N-substituted acrylamide polymer or copolymer.

19. In the assemblage of claim 18, the further improvement wherein said first timing layer comprises poly(N-isopropylacrylamide-co-acrylamide) (90:10 weight ratio).

20. In the assemblage of claim 15, the further improvement wherein said development accelerator is a hydroquinone ester or precursor thereof.

21. In the assemblage of claim 15, the further improvement wherein the penetration time of said first timing layer is from about 1 to about 3 minutes and the penetration time of said second timing layer is from about 5 to about 7 minutes.

22. In a process for producing a photographic transfer image in color from an imagewise-exposed photosensitive element comprising a support having thereon at least one negative-working photosensitive silver halide emulsion layer having associated therewith a dye image-providing material comprising a positive-working redox dye-releaser, said process comprising treating said element with an alkaline processing composition in the presence of a silver halide developing agent to effect development of each of said exposed silver halide emulsion layers, said processing composition contacting said emulsion layer prior to contacting a neutralizing layer, whereby an imagewise distribution of dye image-providing material is formed as a function of development and at least a portion of it diffuses to a dye image-receiving layer to provide said transfer image, a first timing layer associated with said neutralizing layer being permeated by said alkaline processing composition after a predetermined time, said first timing layer being located between said neutralizing layer and said photosensitive silver halide emulsion layer, and a second timing layer associated with said neutralizing layer also being permeated by said alkaline processing composition after a predetermined time, said second timing layer being located between said first timing layer and said neutralizing layer, said first and second timing layers being so located that said processing composition must first permeate said timing layers before contacting said neutralizing layer, said neutralizing layer being located on the side of said second timing layer which is farthest from said dye image-receiving layer, whereby said alkaline processing composition is neutralized by means of said neutralizing layer associated with said timing layers after said predetermined times; the improvement which comprises:

(i) releasing a silver halide development accelerator from said first timing layer having a negative temperature coefficient; and (ii) permeating said second timing layer by said alkaline processing composition after permeation of said first timing layer by said alkaline processing composition, so that said neutralizing layer will be permeated by said alkaline processing composition only after said silver halide development has been substantially completed.

23. A dye image-receiving element adapted to be permeated by an alkaline processing composition, said element comprising a support having thereon, in sequence, a neutralizing layer, a second timing layer, a first timing layer and a dye image-receiving layer, said first timing layer having a negative temperature coefficient and having a silver halide development accelerator located therein or in a layer intermediate said first and second timing layers, and said second timing layer having a penetration time by said alkaline processing composition that is greater than the penetration time of said first timing layer.

24. The element of claim 23 wherein said first timing layer is an N-substituted acrylamide polymer or copolymer.

25. The element of claim 24 wherein said first timing layer comprises poly(N-isopropylacrylamide-co-acrylamide) (90:10 weight ratio).

26. The element of claim 23 wherein said development accelerator is a hydroquinone ester or precursor thereof.

27. The element of claim 23 wherein the penetration time of said first timing layer is from about 1 to about 3 minutes and the penetration time of said second timing layer is from about 5 to about 7 minutes.

28. A cover sheet adapted to be permeated by an alkaline processing composition, said cover sheet comprising a transparent support having thereon, in sequence, a neutralizing layer, a second timing layer and a first timing layer, said first timing layer having a negative temperature coefficient and having a silver halide development accelerator located therein or in a layer intermediate said first and second timing layers, and said second timing layer having a penetration time by said alkaline processing composition that is greater than the penetration time of said first timing layer.

29. The cover sheet of claim 28 wherein said first timing layer is an N-substituted acrylamide polymer or copolymer.

30. The cover sheet of claim 29 wherein said first timing layer comprises poly(N-isopropylacrylamide-co-acrylamide) (90:10 weight ratio).

31. The cover sheet of claim 28 wherein said development accelerator is a hydroquinone ester or precursor thereof.

32. The cover sheet of claim 28 wherein the penetration time of said first timing layer is from about 1 to about 3 minutes and the penetration time of said second timing layer is from about 5 to about 7 minutes.

33. In a photographic element adapted to be permeated by an alkaline processing composition, said element comprising a support having thereon, in sequence, a neutralizing layer, a second timing layer, a first timing layer, and at least one negative-working, photosensitive silver halide emulsion layer having associated therewith a positive-working, redox dye-releaser, the improvement wherein:

(i) said first timing layer has a negative temperature coefficient and has a silver halide development accelerator located therein or in a layer intermediate said first and second timing layers; and (iv) said second timing layer has a penetration time by said alkaline processing composition that is greater than the penetration time of said first timing layer, so that said neutralizing layer will be permeated by said alkaline processing composition only after development of said silver halide emulsion has been substantially completed.

34. The element of claim 33 wherein said positive-working redox dye-releaser is a quinone redox dye-releaser and said photographic element contains an incorporated reducing agent.

35. The element of claim 34 wherein said quinone redox dye-releaser has the formula:

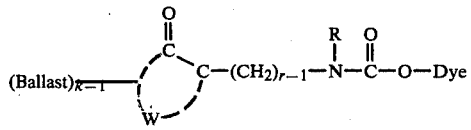

wherein:

Ballast is an organic ballasting radical of such molecular size and configuration as to render said compound nondiffusible in said photographic element during development in said alkaline processing composition;

W represents at least the atoms necessary to complete a quinone nucleus;

r is a positive integer of 1 or 2;

R is an alkyl radical having 1 to about 40 carbon atoms or an aryl radical having 6 to about 40 carbon atoms;

k is a positive integer of 1 to 2 and is 2 when R is a radical of less than 8 carbon atoms; and Dye is an organic dye or dye precursor moiety.

36. In the element of claim 33, the further improvement wherein said first timing layer is an N-substituted acrylamide polymer or copolymer.

37. In the element of claim 36, the further improvement wherein said first timing layer comprises poly(N-isopropylacrylamide-co-acrylamide) (90:10 weight ratio).

38. In the element of claim 33, the further improvement wherein said development accelerator is a hydroquinone ester or precursor thereof.

39. In the element of claim 33, the further improvement wherein the penetration time of said first timing layer is from about 1 to about 3 minutes and the penetration time of said second timing layer is from about 5 to about 7 minutes.

* * * * *